US008096370B2

(12) United States Patent
Schneider

(10) Patent No.: US 8,096,370 B2
(45) Date of Patent: Jan. 17, 2012

(54) APPARATUS AND METHOD FOR PRODUCING SOIL ELEMENTS UNDERGROUND

(75) Inventor: Nikolaus Schneider, Wildenbruck (DE)

(73) Assignee: GuD Ingenieurburo fur Spezialtiefbau GmbH, Berlin (DE)

( * ) Notice: Subject to any disclaimer, the term of this patent is extended or adjusted under 35 U.S.C. 154(b) by 436 days.

(21) Appl. No.: 12/223,014

(22) PCT Filed: Jan. 19, 2007

(86) PCT No.: PCT/EP2007/000466

§ 371 (c)(1),
(2), (4) Date: Nov. 26, 2008

(87) PCT Pub. No.: WO2007/101500

PCT Pub. Date: Sep. 13, 2007

(65) Prior Publication Data

US 2009/0178849 A1 Jul. 16, 2009

(30) Foreign Application Priority Data

Jan. 20, 2006 (DE) ..... 10 2006 002 838

(51) Int. Cl.
*E21B 47/08* (2006.01)
*E21B 47/00* (2006.01)

(52) U.S. Cl. ..... 175/48; 175/45; 175/50; 175/67; 175/424

(58) Field of Classification Search ..... 175/40, 175/48, 50, 58, 59, 45, 67, 424; 405/223, 405/236, 237, 248, 231, 232
See application file for complete search history.

(56) References Cited

U.S. PATENT DOCUMENTS 5,291,956 A * 3/1994 Mueller et al. ..... 175/67
5,419,405 A 5/1995 Patton
6,497,282 B2 * 12/2002 Frappin ..... 166/253.1

FOREIGN PATENT DOCUMENTS

DE 44 29 917 A1 2/1996
DE 199 49 393 C1 6/2001
DE 100 64 187 C1 5/2002
DE 103 12 912 A1 10/2004

OTHER PUBLICATIONS

International Preliminary Report on Patentability from corresponding International Application No. PCT EP/2007/000466, dated Apr. 24, 2008.

* cited by examiner

*Primary Examiner* — Brad Harcourt
(74) *Attorney, Agent, or Firm* — Wolf, Greenfield & Sacks, P.C.

(57) ABSTRACT

The invention relates to an apparatus and a method for producing nozzle jet columns underground comprising a bore and nozzle rod arrangement (1) for producing a borehole and a nozzle jet column in the region of the borehole, and a measuring device (14) for measuring the nozzle jet column, in particular the diameter of the nozzle jet column, the measuring device (14) being at least partially integrated into the bore and nozzle rod arrangement (1) so that it is possible to measure the nozzle jet column using the mechanical measuring device (14) without the bore and nozzle rod arrangement (1) having previously been withdrawn from the borehole.

18 Claims, 10 Drawing Sheets

APPARATUS AND METHOD FOR PRODUCING SOIL ELEMENTS UNDERGROUND

FIELD OF THE INVENTION

The present invention relates to an apparatus and a method for producing and measuring nozzle jet columns underground, comprising a bore and nozzle rod arrangement for producing a borehole and a nozzle jet column in the region of the borehole.

PRIOR ART

The method for producing nozzle jet columns is a method from specialist underground engineering with which a high-energy high pressure jet of water and/or binder passes out of a rotating bore and nozzle rod arrangement, and in so doing demolishes the stratification structure of the surrounding soil, and then creates mortar by the addition of water and/or the binder.

In order to loosen the soil and introduce the water and/or the binder, different methods are used which differ, for example, in the number and/or arrangement of the nozzles in the bore and nozzle rod arrangement and in the cutting medium used. Which method is advantageous in each individual case depends on geological factors such as particle size distribution, bulk density, shearing strength, state, organic components and compressive strength of the soil. A bore and nozzle jet rod arrangement is known, for example, from DE 198 49 786 A1.

The size of a nozzle jet column produced depends not only upon the character of the soil, but also upon the pressure of the nozzle and the diameter of the nozzle.

Depending on the field of application, individual nozzle jet columns or several, preferably overlapping, nozzle jet columns are produced by means of the nozzle jet technology. The size of an individual nozzle jet column is dependent upon a plurality of factors which cannot always be predicted with sufficient accuracy. It is therefore known to produce so-called test columns in order to determine specific parameters affecting the diameter. The diameter achieved by the test column can then form the basis of the planning of further embodiments.

In order to establish the diameter of the test column and/or of a nozzle jet column in general, various methods are known, for example a mechanical measuring screen, a hydraulic measuring screen, a calibre measuring probe as well as non-mechanical measuring methods, for example a level measuring method, a range measurement using the hydrophone method, determining a range by measuring the elapsed time, or a floating body method. These methods are generally implemented on a nozzle jet element which has not yet hardened. As well as these, tests on a hardened nozzle jet column are known where the test column is uncovered or exploratory holes are made.

Mechanical measuring methods are generally preferred due to their simple design and their minor susceptibility to failure. In order to determine the diameter here—after removing the bore and nozzle rod arrangement—the measuring device is introduced into the borehole. The simple mechanical measuring screen consists, for example, of three measuring arms which rest against a borehole wall by means of a flap mechanism. The size of the borehole can be determined by means of the flap angle. The mechanical measuring screen, in folded state, is preferably dropped through the borehole into the fresh, not yet hardened nozzle jet column directly after the nozzle jet column has been produced. The measuring screen is opened by a cable winch mechanism. The opening angle of the measuring screen can be determined, for example, by the path of the cable winch.

As well as this, a measuring device is known which uses a flexible sampling element. After lowering the measuring device, the sampling element is extended from the measuring device at an angle of approx. 90° to the latter, until it reaches the bore wall. The diameter of the nozzle jet column can be derived by means of the range of the extended sampling element.

However, the methods have in common the disadvantage that a bore and nozzle rod must first of all be removed in order to introduce a measuring device into the borehole. Due to the amount of time associated with this, continuous monitoring of the quality of individual nozzle jet columns is only advantageous in specific applications. Moreover, the removal of the bore and nozzle rod arrangement can lead to the borehole collapsing and the measuring device which is then introduced cannot therefore be introduced right up to the nozzle jet column.

The use of a sound transmitter for determining the diameter of a nozzle jet column is known from DE 196 22 282 A1. Since the reflection properties of the soil suspension mixture and of the soil are very similar, however, there is no metrologically clear boundary layer on which the sound waves are reflected. Consequently, measurement by means of sound waves is not suitable for all types of application.

Furthermore, EP 0 940 559 A2 discloses an apparatus of the same category with which a measuring line with a floating body is carried along by the flow of a high pressure injection jet so that the length of the measuring line corresponds to the effective length of the high pressure injection jet. From this one should be able to deduce the diameter of a nozzle jet column produced. The nozzle jet column can therefore only be measured during the high pressure injection operation, and the measurement result is affected by the pressure prevailing in the high pressure injection jet. This leads to an inflexible measuring process associated with measuring uncertainties.

DESCRIPTION OF THE INVENTION

It is therefore the object of the present invention to provide an apparatus and a method for producing and measuring nozzle jet columns underground, where it is possible to flexibly and reliably monitor the quality of the nozzle jet columns, by means of which said quality is also better safeguarded.

According to the invention, the apparatus for producing and measuring nozzle jet columns underground comprises a bore and nozzle rod arrangement for producing a borehole and a nozzle jet column in the region of the borehole, and a measuring device for measuring the nozzle jet column, in particular the diameter of the nozzle jet column, the measuring device being at least partially integrated into the bore and nozzle rod arrangement.

Furthermore, the measuring device according to the invention has at least one longitudinally rigid sampling element which can be moved between a position retracted into the bore and nozzle rod arrangement and an extended position. The term "longitudinally rigid" identifies sampling elements which, unlike ropes or the like, are suitable for transferring a certain pressure force. In this way it is made possible to extend the sampling element without having to pull on the front (leading) end of the sampling element. Instead, this front end of the sampling element is provided to be brought to rest against the wall of a nozzle jet column produced.

In the retracted position of the sampling element it is ensured that the latter does not have a disruptive effect on the work when a borehole and a nozzle jet column are being produced. By extending the sampling element, the size of the nozzle jet column produced can then be measured. The sampling element is preferably extended for as long as the nozzle jet column has not yet hardened. The sampling element is moved radially here through the nozzle jet column which is still fluid.

A predominantly mechanical measuring device is advantageous within the framework of the present invention due to its small susceptibility to failure. However, the mechanical measuring device can be combined with individual electronic elements. By integrating the mechanical measuring device into the bore and nozzle rod arrangement, it is possible to measure the nozzle jet column without removing the bore and nozzle rod arrangement. The nozzle jet column can therefore be measured quickly and reliably.

In a preferred embodiment, the sampling element is bend-resistant, at least in sections, but still flexible, the flexibility preferably being such that the sampling element can be turned within the bore and nozzle framework by an angle of approximately 90°. In the retracted position, the flexible sampling element preferably extends substantially along an axis of the bore and nozzle rod arrangement. For measuring, the sampling element passes out of the bore and nozzle rod arrangement at an angle of approx. 90°. In this way, it is possible to accommodate the sampling element in the bore/nozzle rod arrangement in a space-saving manner.

In a further embodiment, the sampling element is made, at least in sections, of a fibre-reinforced material, in particular of one or of a plurality of CFK and/or GFK rods. Alternatively, the sampling element can also be made of other elastic or bendable elements such as, for example, a steel spring, a power track chain or the like.

The sampling element is preferably coated with a membrane (made of rubber, for example) and/or disposed around a membrane. By means of the membrane, the buoyancy of the sampling element is improved. In this way one obtains a flexible element which, as a closed element, spans a relatively large area so that buoyant forces from the fluid suspension counter the weight of the sampling element in the extended state. In addition, this membrane can also be acted upon by a compressed fluid in order to increase the rigidity of the sampling element.

In a further embodiment, the sampling element is equipped with a sensor, in particular a pressure sensor and/or a inclinometer. If the sampling element is in the form of a steel spring, the sensor or sensors can be provided, for example, in the area spanned by the spring. The pressure sensor is disposed, for example, on an end of the sampling element touching the wall of the borehole. In this way, the borehole wall can also be reliably identified even with relatively loose soil.

By means of the clinometer, the alignment of the sampling arm during a measuring process can be recorded and controlled, so that the desired position of the sampling element can be verified.

Preferably, the bore and nozzle rod arrangement has at least one nozzle jet nozzle and at least one drill bit, the sampling element being disposed between the nozzle jet nozzle and the drill bit. This type of arrangement is particularly advantageous due to a required installation space and/or a connection of the measuring element to the bore and nozzle rod arrangement.

In a further embodiment, the measuring device comprises actuation means for the sampling element. By means of the actuation means, the sampling element is extended until, for example, the resistance due to the contact of the sampling element with the borehole wall counters the movement and/or a pressure sensor signals an end of a movement. Particularly simple movement of the sampling element is made possible by the actuation means.

The actuation means can be designed in a wide variety of ways within the framework of the present invention. One embodiment has proved to be advantageous here with which the actuation means have an actuation piston provided within the bore and nozzle rod arrangement. With an alternative embodiment, the actuation means have an electrical actuator provided within the bore and nozzle rod arrangement which preferably drives drive means, in particular at least one drive roll, with a gearing being particularly preferably provided between the drive means and the electrical actuator.

In a further embodiment, the measuring device has at least one measuring element for measuring a displacement path and/or an inclination of the sampling element and/or of the actuation means. By means of the displacement path and/or the inclination of the sampling element, a diameter of the nozzle jet column can be determined. The measuring device can comprise, for example, a high power magnet which is integrated into an element for displacing the sampling element, a recording device being disposed parallel to the lift region of the displacement element and which reacts to a magnetic field of the high power magnet. In the case of an electric actuator with drive roll(s), the measuring device can also have, for example, a counting device (e.g. incremental encoder) which records the number of rotations of the drive roll(s).

Preferably, the bore or nozzle rod arrangement has a compressed fluid duct, in particular a compressed air duct, which is connected to at least one nozzle jet air nozzle and/or to an outlet of the sampling element from the bore and nozzle rod arrangement and/or to at least one side of the actuation piston. In this way, the compressed fluid duct can fulfil several objectives, the more so as the production and measurement of the nozzle jet column preferably do not take place at the same time. A compressed fluid duct used for the nozzle jet air nozzle can therefore also preferably be used for flushing the outlet of the sampling element from the bore and nozzle rod arrangement and/or if appropriate a movement of the sampling element. However, it is also conceivable to provide an additional compressed fluid duct for flushing the outlet of the sampling element from the bore and nozzle rod arrangement and/or for moving the actuation piston. In particular, if available, a working fluid other than that for producing the nozzle jet column can also be used for the movement of the actuation piston.

When using a common compressed fluid duct, at least one valve is preferably provided which is disposed so as to break the connection between the compressed fluid duct and the actuation piston and/or the connection between the compressed fluid duct and the nozzle jet air nozzle. In this way, in a particularly favourable way, it is possible for the actuation piston and the nozzle jet air nozzle to use a common compressed fluid duct. However, it is also conceivable to provide the valve purely for controlling the movement of the actuation piston.

In an advantageous further development, the compressed fluid duct can be connected alternately to a pneumatic and a hydraulic supply by a switch-over means. In this way, depending on the application, an appropriate supply type, i.e. an appropriate working fluid such as for example compressed air or hydraulic fluid, can be selected.

In a further embodiment, the measuring device has a power supply integrated into the bore and nozzle framework. The power supply is well protected against disruptive influences from the outside in the bore and nozzle rod arrangement. The power supply supplies various components of the measuring device such as, for example, sensors, magnetic valves or similar. The power is supplied, for example, by means of integrated accumulator units so that cabling can be at least partially dispensed with.

In a further embodiment, the measuring device has a data storage device integrated into the bore and nozzle rod arrangement. In this way, data which were for example recorded when measuring the nozzle jet column can be entered in the data storage device. These data can be read out, for example, when extending the bore and nozzle rod arrangement.

In a further embodiment, the bore and nozzle rod arrangement has an integrated data interface which is preferably designed for contact-free data transfer, in particular by means of infrared, Bluetooth or the like. In this way, the data recorded by the measuring device can be conveyed directly to a surface, and be analysed here with appropriate equipment. This also enables, for example, direct improvement or renewed insertion of the bore and nozzle rod arrangement.

In a further embodiment, the apparatus comprises an inclination sensor, it being possible to read at least the inclination of the bore and nozzle rod arrangement by means of the inclination sensor. By means of this type of inclination sensor, the actual borehole progress can be recorded in an appropriate way. The inclination can also be indicated, for example, in relation to the North direction. In this way, not only can an actual bore starting point and the diameter measured according to the invention, but also the vertical borehole extension be included in an analysis of the data from the nozzle jet column and these can be analysed together. If there is no direct transfer of the data measured to the surface, it is advantageous to record an inclination profile along the borehole with the inclinometer and to save this.

The method for producing and measuring a nozzle jet column underground includes the following steps: creating a borehole underground using the bore and nozzle rod arrangement, creating a nozzle jet column in the region of the borehole using the bore and nozzle rod arrangement, measuring the nozzle jet column using the (mechanical) measuring device without the bore and nozzle rod arrangement having previously been withdrawn from the borehole. By measuring without having withdrawn the bore and nozzle rod, it is possible to control quality quickly and reliably. The measurement data are analysed either directly by transferring the data to the surface (e.g. by radio) and/or indirectly by saving the data and reading out the data after the bore and nozzle rod arrangement has been withdrawn from the borehole.

BRIEF DESCRIPTION OF THE DRAWINGS

The invention is described in the following by means of a preferred embodiment. For the same components, uniform reference numbers are used here. The drawings show as follows.

IMPLEMENTATION OF THE INVENTION

Figure 1:
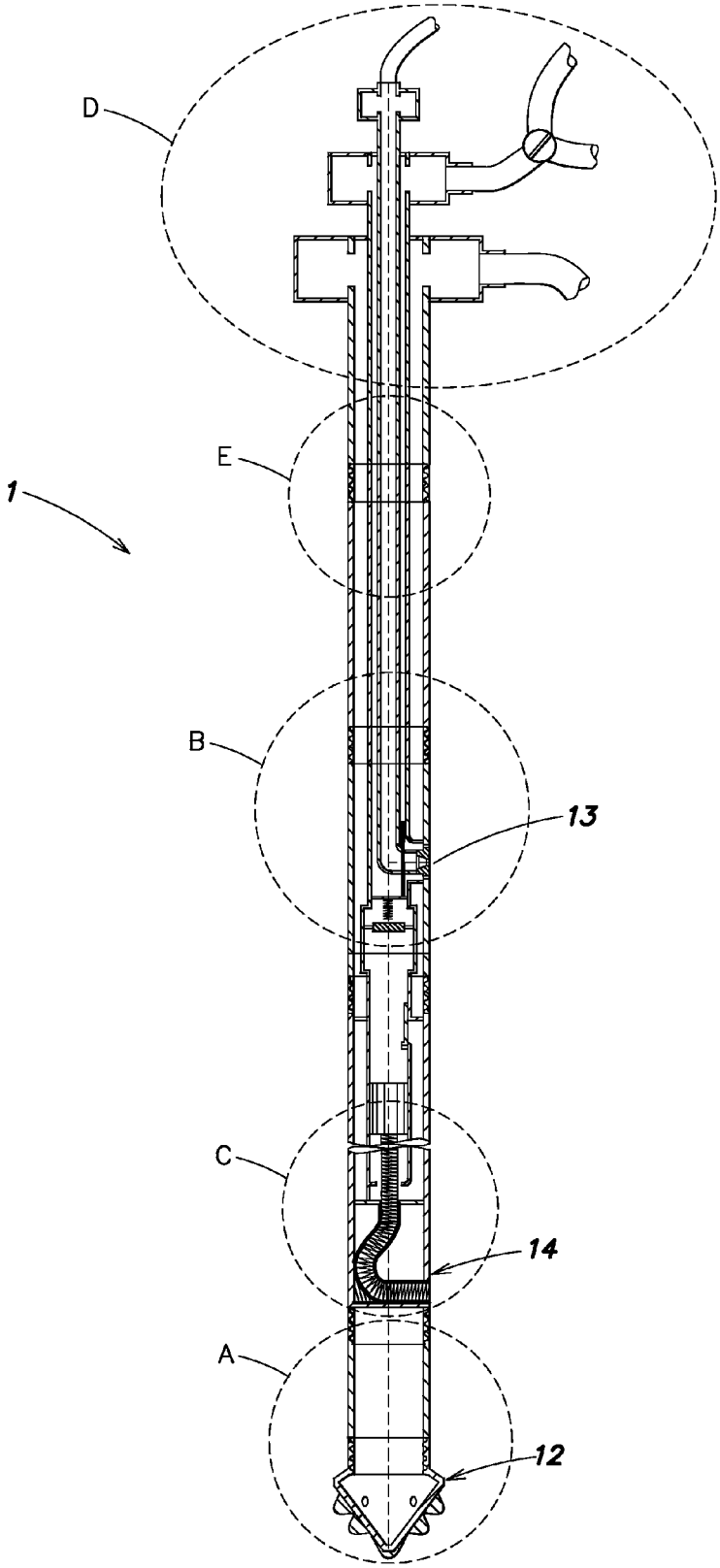
FIG. 1 a cross-sectional representation of an embodiment of a bore and nozzle rod arrangement according to the invention.

FIG. 1 schematically shows a cross-section through a bore and nozzle rod arrangement 1 according to the invention according to a first embodiment. The bore and nozzle rod arrangement comprises a drill bit 12, shown in detail in FIG. 2, a region shown in detail in FIG. 3 with a nozzle for applying a nozzle air jet, a region shown in detail in FIGS. 4A, 4B and 5 for the measuring device 4, a connection region 5 shown in detail in FIG. 6, and an intermediate region shown in detail in FIG. 7.

Figure 2:
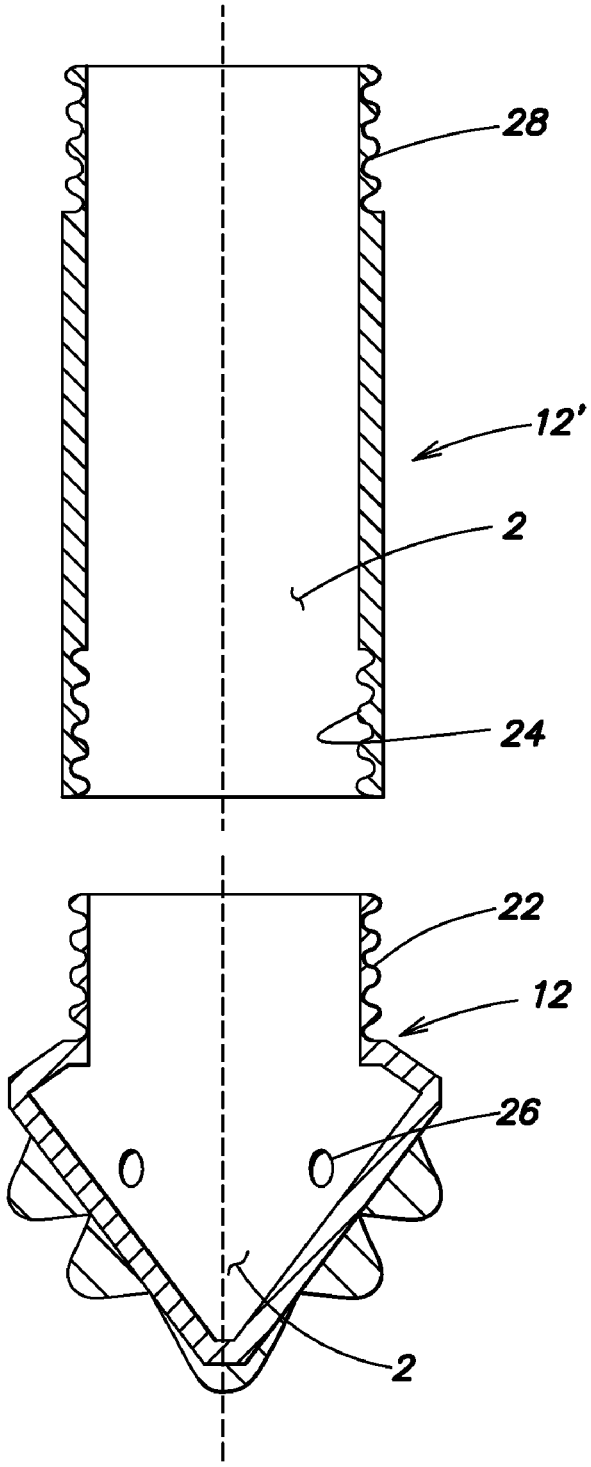
FIG. 2 an enlargement of region A according to FIG. 1.

FIG. 2 schematically shows the drill bit 12 which can be connected to a transition part 12'. For the connection between the drill bit 12 and the transition part 12', a standard thread 22 with a male and female part 24 is provided. In the drill bit 12 and the transition part 12' there is a bore flusher 2. The drill bit 12 has an opening 26 for the bore flusher 2. By means of a standard thread 28, the transition part 12' can be connected to the adjoining part of the bore and nozzle rod arrangement 1 shown in FIG. 1. Of course, other threads and/or other connection elements are conceivable instead of standard threads.

Figure 3:
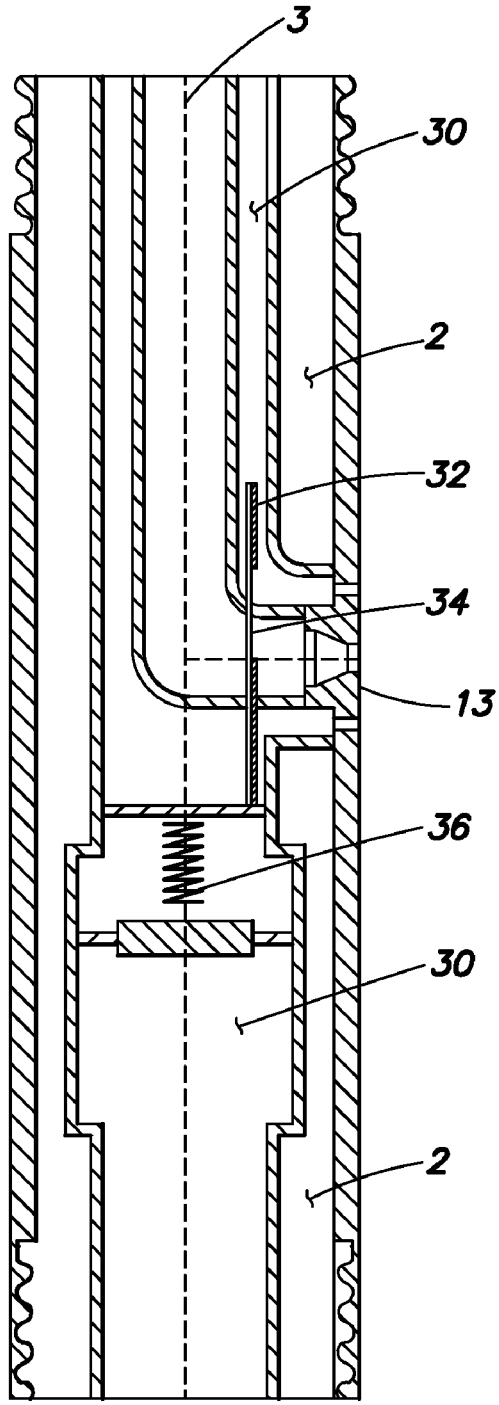
FIG. 3 an enlargement of region B according to FIG. 1.

FIG. 3 schematically shows a nozzle 13 for applying a high pressure suspension 3 under high pressure. The working fluid for supporting the high pressure suspension is preferably air. The working fluid is located in the compressed fluid duct 30. The duct for the working fluid co-operates with a blocking plane 32, 34 which is made up from several parts. The duct for the working fluid is opened or closed dependent on the pressure in the compressed fluid duct 30 and a spring 36 or, if appropriate, by a suitable valve. In the compressed fluid duct 30 there is water or air, dependent on the step, for hydraulic or pneumatic supply. Pneumatics are preferably used here to open and close the duct for the working fluid. With high pressures in the compressed fluid duct 30, the horizontal outlet of the duct with the working fluid is closed. The compressed fluid duct 30 can then be used to supply the measuring device 14.

Figure 4A:
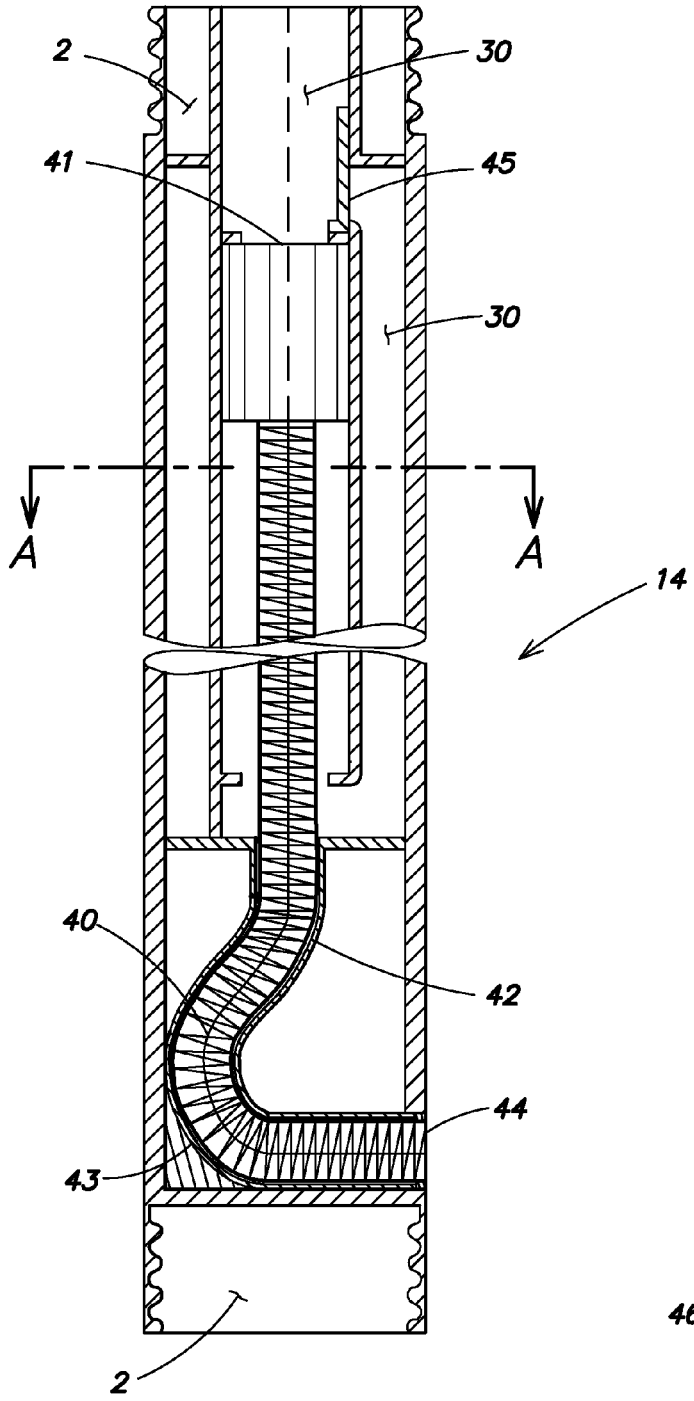
FIG. 4A an enlargement of the representation of region C according to FIG. 1.

FIG. 4A schematically shows the region C according to FIG. 1 in which the mechanical measuring device 14 is located. The measuring device 14 comprises a sampling element 40 which can be moved by means of an actuation piston 41. The sampling element 40 is moved along a wall 42 including a turn 43. The sampling element 40 is turned here by approximately 90° from the axial direction of the bore and nozzle rod arrangement. At one point 44 the sampling element 40 passes out of the bore and nozzle rod arrangement. The opening 44 is preferably designed with seals appropriate for preventing dirt from entering. Auxiliarily, the opening 44 can be connected to the compressed fluid duct 30 so that the sampling element 40 is flushed by the compressed fluid so as to obviate any protective application.

In the present embodiment, movement of the sampling element 40 by means of the actuation piston 41 is preferably implemented pneumatically or hydraulically. The working fluid, preferably compressed air, is introduced in the compressed fluid duct 30 and in the step shown acts upon the actuation bolt 41. If the pressure is insufficient for actuation of the actuation piston 41, the sampling element 40 remains in the retracted position. By closing a valve 45, the working fluid acts upon the actuation bolt 41 in the opposite direction via the compressed fluid duct 30. In this way the sampling element 40 can be moved from an extended position into the retracted position. Instead of returning the sampling element 40 actively, it is also conceivable to move it back passively by means of an appropriate element, for example by means of resilient force.

Figure 4B:
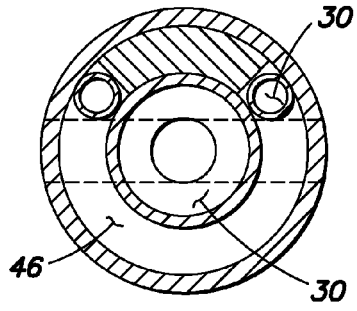
FIG. 4B a sectional representation along A-A according to FIG. 4A.

FIG. 4*b* shows a section through the bore rod along line A-A according to FIG. 4A. As can be seen clearly in FIG. 4B, a cross-sectional region 46 is provided in which, for example, a power supply, an inclinometer, a programmable control for the measuring device or the like can be integrated. The power supply is preferably implemented by accumulator elements.

Figure 5:
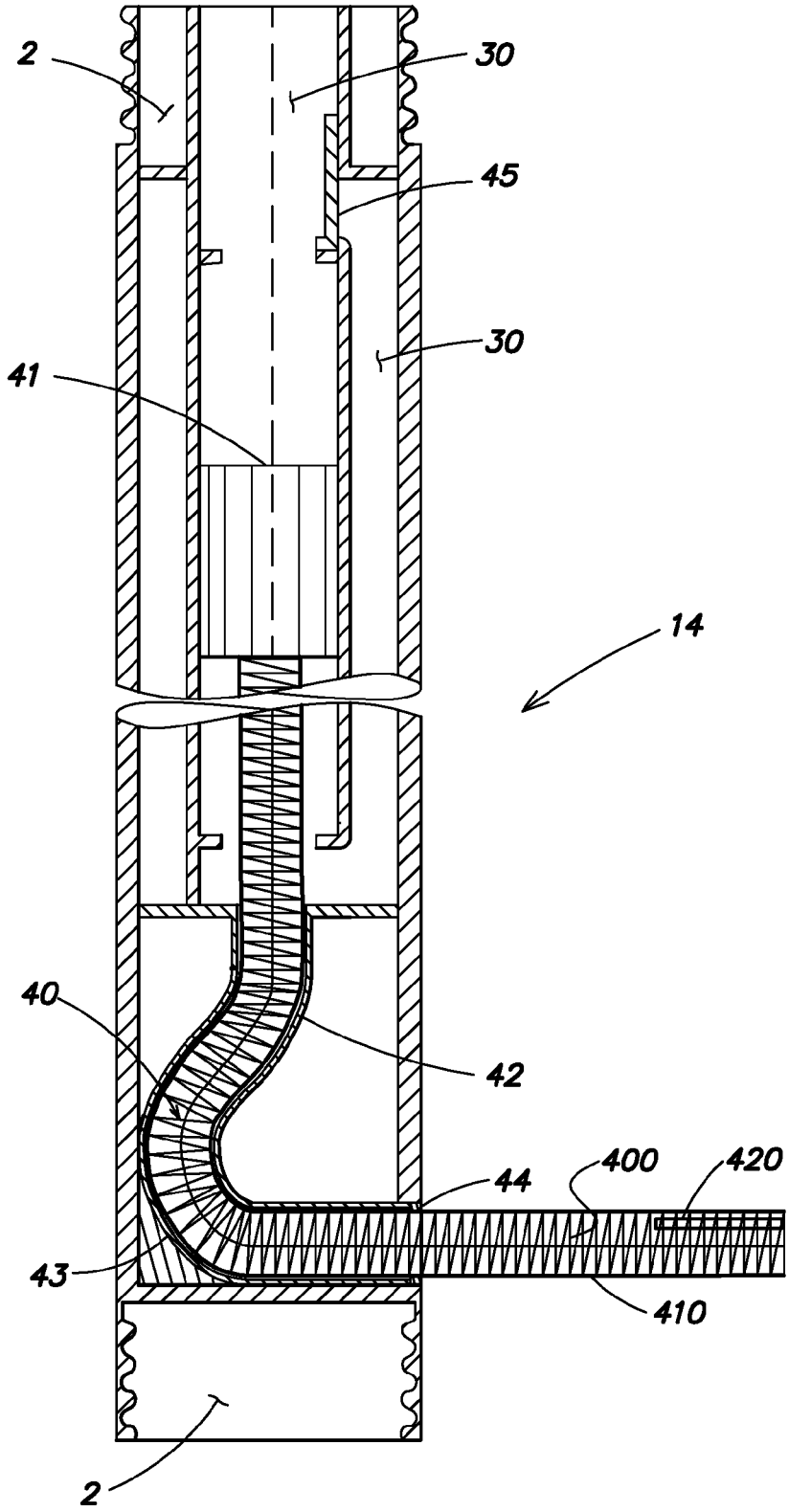
FIG. 5 an enlarged representation of region C according to FIG. 1 in a second state.

FIG. 5 schematically shows the measuring device 14, the sampling element 40 being located in an at least partially extended position. As shown in FIG. 5, the sampling element 40 is in the form of a steel spring 400 which is coated with a rubber coating 410. Disposed in the area spanned by the steel spring 400 is a sensor, for example a inclinometer 420. The sampling element 40 moves in the nozzle jet column (not shown) which has not hardened. The sampling element 40 is designed such that the weight of the sampling element 40 is at least partially compensated by the buoyant force. For example, the material of the nozzle jet column can have a specific weight which is clearly greater than that of water (e.g. greater than 1.5 $t/m^3$). With a sampling element 40, lowering is prevented due to the structure. The sampling element 40 can be extended here for example by 2 m or more. In order to increase the rigidity of the sampling element 40, the latter can in addition be acted upon from the inside by a compressed fluid.

Figure 6:
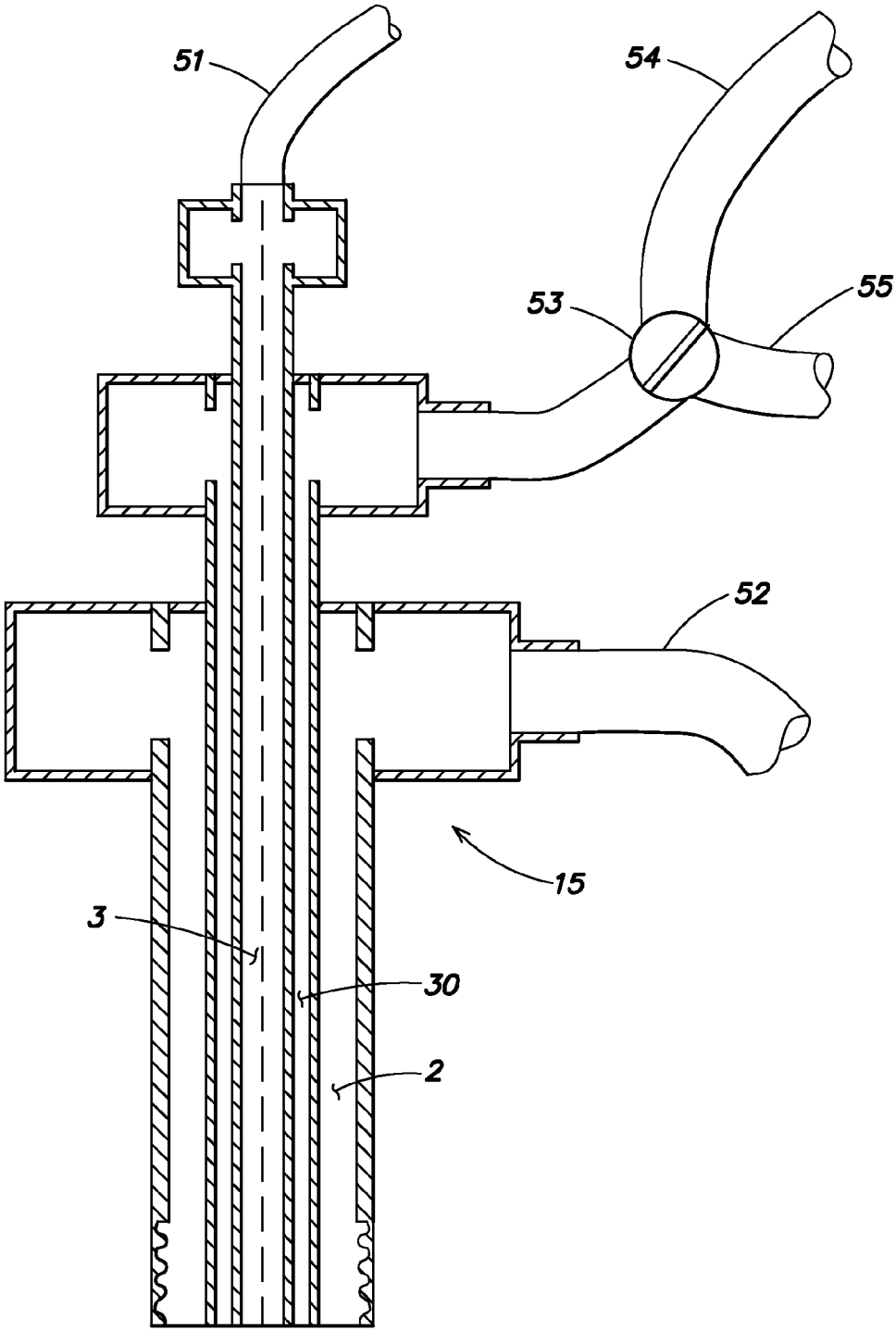
FIG. 6 an enlarged representation of region D according to FIG. 1.

FIG. 6 schematically shows a connection region 15 of the bore and nozzle rod arrangement. The connection region 15 comprises a connection 51 for supplying a high pressure suspension 3. The connection region 5 further comprises a hose 52 for supplying the bore flushing 2. In the compressed fluid duct 30 as the working fluid there is either a hydraulic fluid, for example water or compressed air, dependent on the method used, for actuating the sampling element shown in FIGS. 4*a*, 4*b* and 5, or compressed air for opening and closing the nozzle 13 shown in FIG. 3. By means of a switch-over means 53, the compressed fluid duct 30 can be connected alternately to a pneumatic supply 54 or to a hydraulic supply 55. Due to the different pressures with which the working fluids function, supply of the opening and closing mechanism for the nozzle 13 and the sampling element 40 can be implemented via the same compressed fluid duct 30.

Figure 7:
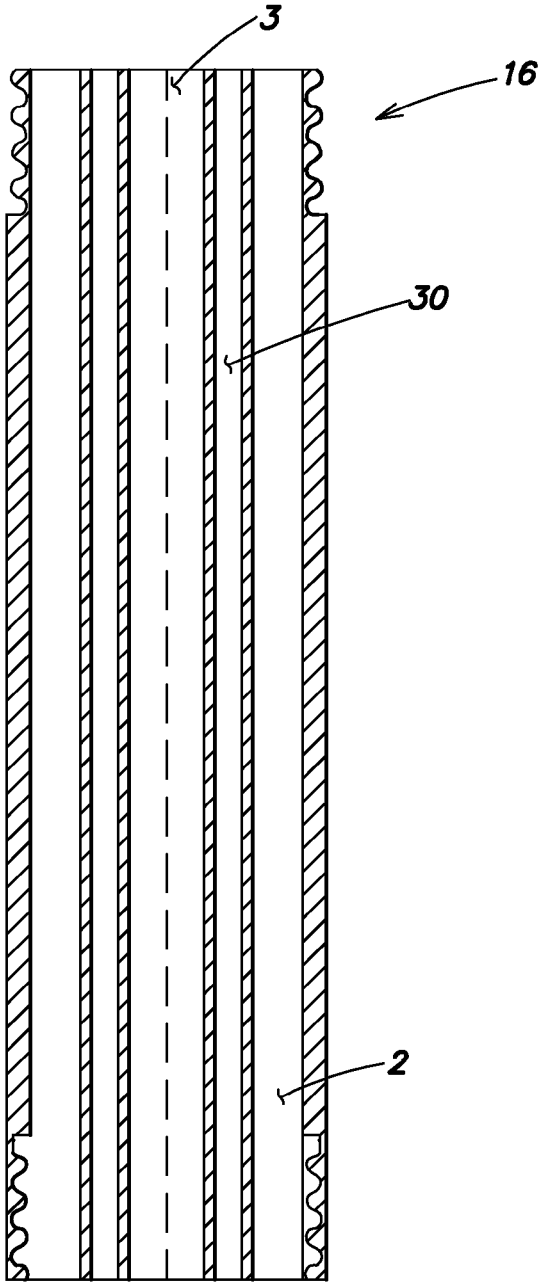
FIG. 7 an enlarged representation of region E according to FIG. 1.

FIG. 7 schematically shows an intermediate region 16 of the bore and nozzle rod arrangement 1, shown in section E of FIG. 1. As can be clearly seen in the intermediate region, the bore and nozzle rod arrangement comprises a duct in which, as explained above, the high pressure suspension 3 is conveyed. The bore and nozzle rod arrangement further comprises the compressed fluid duct 30 which is connected to a pneumatic or a hydraulic supply. In addition, a duct is provided for the bore flushing 2.

Figure 8:
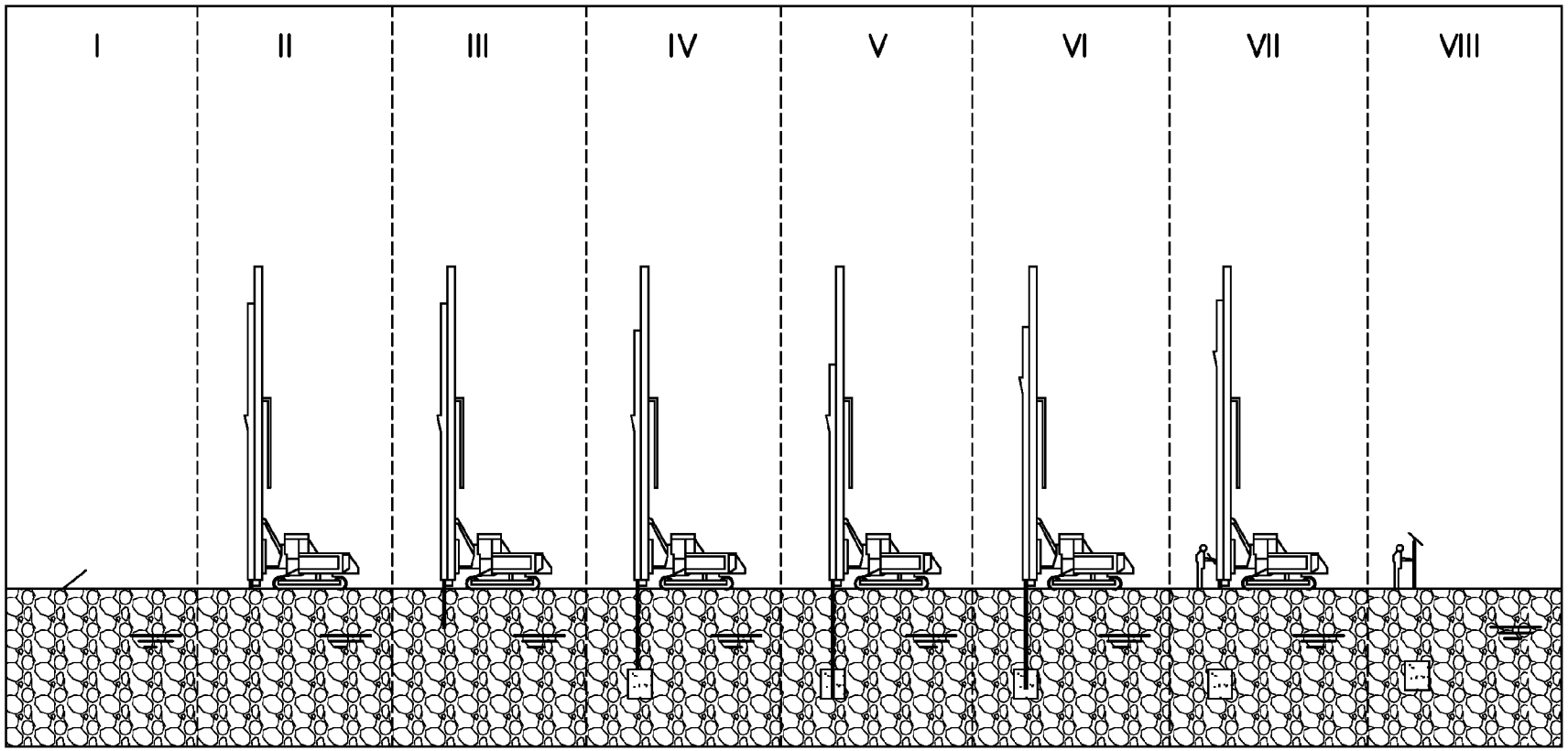
FIG. 8 an illustration of a method according to the invention for producing a nozzle jet column.

FIG. 8 schematically shows different steps I-VIII of a method for producing and measuring a nozzle jet column underground. In a first step I an appropriate bore starting point is first of all gauged. In step II the bore and nozzle rod arrangement is inserted at the new bore starting point. In step III the bore and nozzle rod arrangement is lowered to a desired depth by drilling, it being possible to measure the borehole progress as drilling takes place by means of the inclination sensors which are fitted.

After reaching the desired depth, a nozzle jet column is produced in the region of the borehole in a step IV. In steps V and VI the diameter of the nozzle jet column produced is measured at different heights. In so doing, the sampling element 40 shown in the preceding figures is moved in the nozzle jet column which has not yet hardened. The sampling element 40 is advantageously designed here such that it is held substantially horizontally due to its buoyancy, rigidity and own weight. In a step VII the bore and nozzle rod arrangement is withdrawn. Data, which were saved during the drilling and measuring in steps V and VI, are now read out. By means of these data, appropriate conclusions can be drawn about the state of the soil, and the state of a nozzle jet column produced dependent upon this. These can be advantageously used for a project following step 8.

As well as this, it is also conceivable to transfer the data to the surface via an appropriate connection (e.g. by radio) during steps V and VI and to measure them here. Using the data, a temporary correction can then be made to the nozzle jet column by means of the bore and nozzle rod arrangement.

Figure 9:
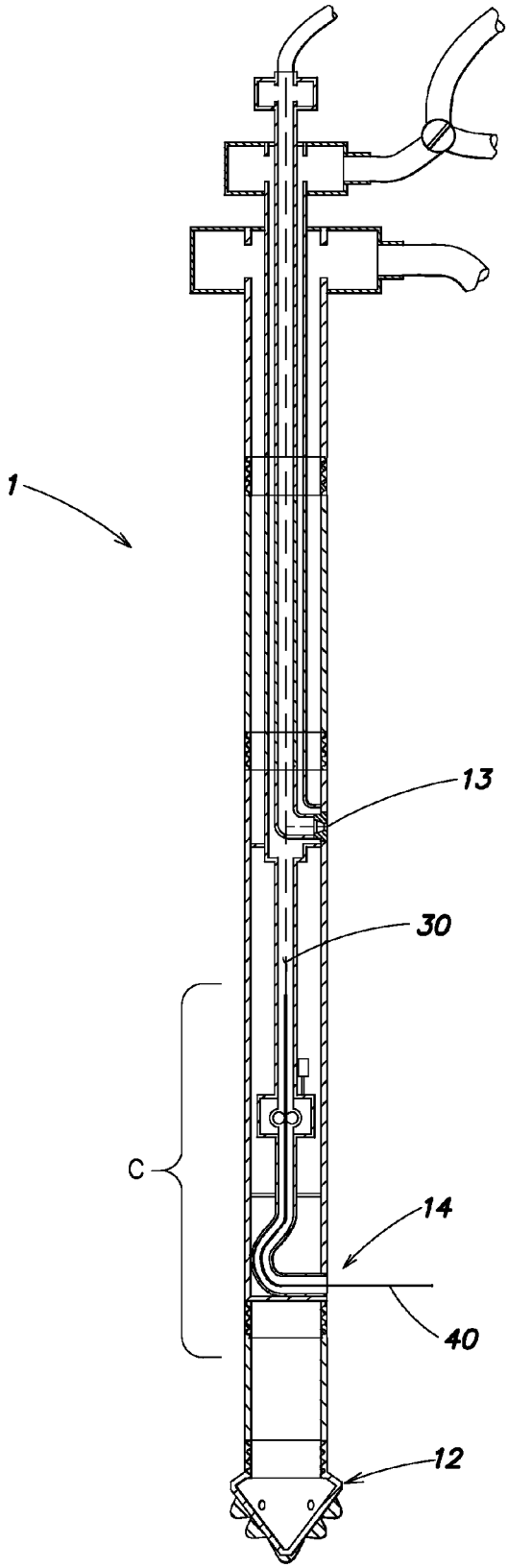
FIG. 9 a cross-sectional representation of a further embodiment of a bore and nozzle rod arrangement according to the invention.
Figure 10:
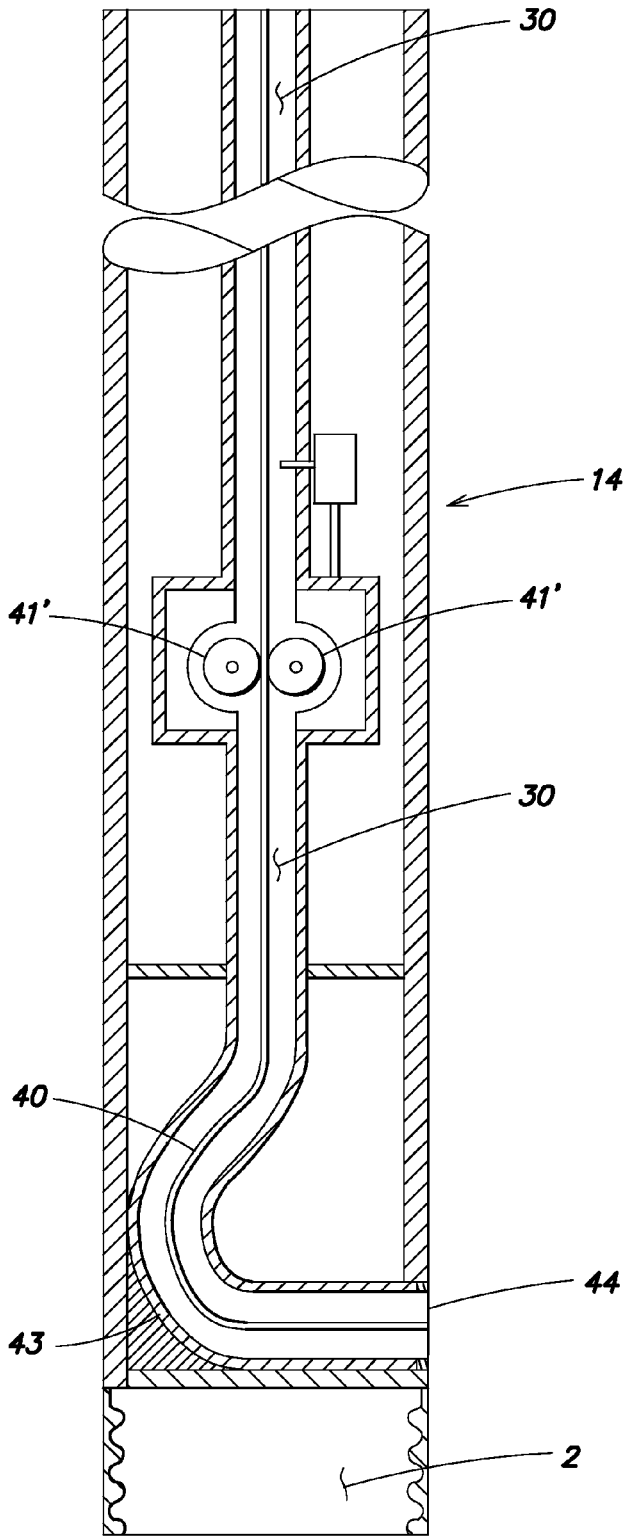
FIG. 10 an enlargement of region C according to FIG. 9.

A further embodiment of the apparatus 1 according to the invention is shown schematically in FIGS. 9 and 10. The structure and operation of this embodiment corresponds in principle to the embodiment described above unless specified to the contrary in the following. The embodiment shown in FIGS. 9 and 10 is characterised in particular in that an electrical actuator, not shown in greater detail, is provided as an actuation means for the sampling element 40, and this moves the sampling element 40 over two drive rolls 41'. These drive rolls' and the corresponding electric motor can also be disposed near to the outlet 44, by means of which there is a particularly stable transfer of power between the drive rolls 41' and the sampling element 44.

Furthermore, the present embodiment makes it possible, in a particularly simple way, for the outlet 44 to be connected to the compressed fluid duct 30 so that the outlet 44 is continuously flushed with compressed fluid, by means of which dirt can be largely prevented from entering along the sampling element 40.

In order to record the displacement path of the sampling element 40, in the present embodiment counting elements, which record the rotations of the drive rolls 41' can be provided instead of measuring elements directly connected to the sampling element 40. These can be, for example, so-called incremental encoders.

Furthermore, the use of an electrical actuator makes it possible, if appropriate, to dispense with provision of a pressure sensor and an inclination sensor in the sampling element 40 because while feeding the sampling element it can be concluded from a surge of current registered by the electrical actuator that the sampling element has reached the wall.

The invention claimed is:

1. An apparatus for producing and measuring nozzle jet columns underground, comprising:

a bore and nozzle rod arrangement for producing a borehole and a nozzle jet column in the region of the borehole, and a measuring device for measuring the diameter of the nozzle jet column, the measuring device being at least partially integrated into the bore and nozzle rod arrangement, wherein the measuring device has at least one longitudinally rigid sampling element which can be moved between a position retracted into the bore and nozzle rod arrangement and an extended position, wherein the rigid sampling element is made, at least in sections, of a fibre-reinforced material, wherein the measuring device further comprises an actuation means for actuating the sampling element, and wherein the actuation means has an actuation piston provided within the bore and nozzle rod arrangement.

2. The apparatus according to claim 1, wherein the sampling element is bend-resistant, at least in sections, and flexible, a flexibility of the sampling element being such that the sampling element can be turned within the bore and nozzle rod arrangement by an angle of approximately 90°.

3. The apparatus according to claim 2, wherein the sampling element is made, at least in sections, of one or of a plurality of CFK and GFK rods.

4. The apparatus according to claim 1, wherein the sampling element is equipped with at least one sensor, said at least one sensor comprising a pressure sensor and/or an inclinometer.

5. The apparatus according to claim 1, wherein the bore and nozzle rod arrangement has at least one nozzle jet nozzle and at least one drill bit, the sampling element being disposed between the nozzle jet nozzle and the drill bit.

6. The apparatus according to claim 1, wherein the actuation means has an electrical actuator provided within the bore and nozzle rod arrangement, the electrical actuator drives at least one drive roll.

7. The apparatus according to claim 1, wherein the measuring device has at least one measuring element for measuring at least one of the displacement path of the sampling element, the inclination of the sampling element, and the displacement path of the actuation piston.

8. The apparatus according to claim 1, wherein the bore and nozzle rod arrangement has a compressed fluid duct which is connected to at least one nozzle jet air nozzle and/or to an outlet of the sampling element from the bore and nozzle rod arrangement and/or to at least one side of the actuation piston.

9. The apparatus according to claim 8, wherein, in the compressed fluid duct, at least one valve is provided which is disposed so as to break a connection between the compressed fluid duct and the actuation piston and/or the connection between the compressed fluid duct and the nozzle jet air nozzle.

10. The apparatus according to claim 8, wherein the compressed fluid duct is alternately connectable to a pneumatic supply and a hydraulic supply by a switch.

11. The apparatus according to claim 1, wherein the measuring device has a power supply integrated into the bore and nozzle rod arrangement.

12. The apparatus according to claim 1, further comprising an inclination sensor configured to measure at least the inclination of the bore and nozzle rod arrangement, the inclination measurements being utilized in combination with measurements from the diameter calculations.

13. The method for producing and measuring nozzle jet columns underground using an apparatus according to claim 1, with the steps:

creating a borehole underground using the bore and nozzle rod arrangement, creating a nozzle jet column in the region of the borehole using the bore and nozzle rod arrangement, and measuring the nozzle jet column using the measuring device without the bore and nozzle rod arrangement having previously been withdrawn from the borehole.

14. An apparatus for producing and measuring nozzle jet columns underground, comprising:

a bore and nozzle rod arrangement for producing a borehole and a nozzle jet column in the region of the borehole, and a measuring device for measuring the diameter of the nozzle jet column, the measuring device being at least partially integrated into the bore and nozzle rod arrangement, wherein the measuring device has at least one longitudinally rigid sampling element which can be moved between a position retracted into the bore and nozzle rod arrangement and an extended position, wherein the measuring device further comprises an actuation means for actuating the sampling element, wherein the bore and nozzle rod arrangement has a compressed fluid duct which is connected to at least one nozzle jet air nozzle and/or to an outlet of the sampling element from the bore and nozzle rod arrangement and/or to at least one side of the actuation piston, and wherein, in the compressed fluid duct, at least one valve is provided which is disposed so as to break a connection between the compressed fluid duct and the actuation piston and/or the connection between the compressed fluid duct and the nozzle jet air nozzle.

15. An apparatus for producing and measuring nozzle jet columns underground, comprising:

a bore and nozzle rod arrangement for producing a borehole and a nozzle jet column in the region of the borehole, and a measuring device for measuring the diameter of the nozzle jet column, the measuring device being at least partially integrated into the bore and nozzle rod arrangement, wherein the measuring device has at least one longitudinally rigid sampling element which can be moved between a position retracted into the bore and nozzle rod arrangement and an extended position, wherein the measuring device further comprises an actuation means for actuating the sampling element, wherein the bore and nozzle rod arrangement has a compressed fluid duct which is connected to at least one nozzle jet air nozzle and/or to an outlet of the sampling element from the bore and nozzle rod arrangement and/or to at least one side of the actuation piston, and wherein the compressed fluid duct is alternately connectable to a pneumatic supply and a hydraulic supply by a switch.

16. An apparatus for producing and measuring nozzle jet columns underground, comprising:

a bore and nozzle rod arrangement for producing a borehole and a nozzle jet column in the region of the borehole, and a measuring device for measuring the diameter of the nozzle jet column, the measuring device being at least partially integrated into the bore and nozzle rod arrangement, wherein the measuring device has at least one longitudinally rigid sampling element which can be moved between a position retracted into the bore and nozzle rod arrangement and an extended position, and wherein the measuring device has a data storage device integrated into the bore and nozzle rod arrangement.

17. An apparatus for producing and measuring nozzle jet columns underground, comprising:

a bore and nozzle rod arrangement for producing a borehole and a nozzle jet column in the region of the borehole, and a measuring device for measuring the diameter of the nozzle jet column, the measuring device being at least partially integrated into the bore and nozzle rod arrangement, wherein the measuring device has at least one longitudinally rigid sampling element which can be moved between a position retracted into the bore and nozzle rod arrangement and an extended position, and wherein the measuring device has a programmable control integrated into the bore and nozzle rod arrangement.

18. An apparatus for producing and measuring nozzle jet columns underground, comprising:

a bore and nozzle rod arrangement for producing a borehole and a nozzle jet column in the region of the borehole, and a measuring device for measuring the diameter of the nozzle jet column, the measuring device being at least partially integrated into the bore and nozzle rod arrangement, wherein the measuring device has at least one longitudinally rigid sampling element which can be moved between a position retracted into the bore and nozzle rod arrangement and an extended position, and wherein the measuring device has a wireless data transfer interface integrated into the bore and nozzle rod arrangement.

* * * * *